US009851161B2

(12) United States Patent
Vos et al.

(10) Patent No.: US 9,851,161 B2
(45) Date of Patent: Dec. 26, 2017

(54) HEAT EXCHANGER CONSTRUCTION USING LOW TEMPERATURE SINTER TECHNIQUES

(75) Inventors: David L. Vos, Apalachin, NY (US); Stephen Schober, Ithaca, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 773 days.

(21) Appl. No.: 13/342,410

(22) Filed: Jan. 3, 2012

(65) Prior Publication Data

US 2013/0168072 A1 Jul. 4, 2013

(51) Int. Cl.

| | |
|---|---|
| ***F28F 7/00*** | (2006.01) |
| ***F28F 21/08*** | (2006.01) |
| *F28F 3/02* | (2006.01) |
| *F28F 1/12* | (2006.01) |

(52) U.S. Cl.

CPC ..... *F28F 21/089* (2013.01); *F28F 1/126* (2013.01); *F28F 3/025* (2013.01); *F28F 2255/18* (2013.01); *F28F 2255/20* (2013.01); *F28F 2275/00* (2013.01); *F28F 2275/02* (2013.01); *Y10T 29/4935* (2015.01)

(58) Field of Classification Search

CPC .. F28F 21/089; F28F 2275/00; F28F 2275/02; F28F 2255/18; F28F 2255/29; F28F 3/025; F28F 1/126; Y10T 29/4935

USPC ..... 29/726, 890.03, 890.039, 890.046, 29/890.054; 165/80.3, 185; 427/256; 361/704, 760

See application file for complete search history.

(56) References Cited

U.S. PATENT DOCUMENTS

| | | | | |
|---|---|---|---|---|
| 4,373,243 | A * | 2/1983 | Nakamura | 29/890.039 |
| 4,606,495 | A * | 8/1986 | Stewart, Jr. | B23K 1/0012 228/181 |
| 6,858,157 | B2 | 2/2005 | Davidson et al. | |
| 6,947,285 | B2 | 9/2005 | Chen et al. | |
| 7,390,428 | B2 | 6/2008 | Davidson et al. | |
| 7,535,099 | B2 | 5/2009 | Suh et al. | |
| 8,900,704 | B1 * | 12/2014 | Zinn | H01L 23/373 361/708 |
| 2003/0174477 | A1 * | 9/2003 | Ohtani et al. | 361/760 |
| 2005/0244644 | A1 | 11/2005 | Hampden-Smith et al. | |
| 2005/0252637 | A1 * | 11/2005 | Leu | B82Y 10/00 165/80.2 |

(Continued)

OTHER PUBLICATIONS

Licht et al., "Sintering Technology Used for Interconnection of Large Areas: Potential and Limitation for Power Modules," CIPS 2010—6th International Conference on Integrated Power Electronics Systems, Nuremberg, Germany, Mar. 16, 2010-Mar. 18, 2010, 5 pages.

*Primary Examiner* — David Bryant
*Assistant Examiner* — Lee A Holly
(74) *Attorney, Agent, or Firm* — Wolf, Greenfield & Sacks, P.C.

(57) ABSTRACT

Some embodiments relate to constructing a heat exchanger using nanoink as a thermal bond interface between portions of the heat exchanger. The heat exchanger may comprise fins and at least one base. A nanoink may be applied to at least a portion of the fins. The pieces of the heat exchanger may be sintered such that the nanoink melts and forms a bond between the pieces of the heat exchanger. Some embodiments include a second base. Some embodiments incorporate dissimilar materials within the heat exchanger construction.

17 Claims, 5 Drawing Sheets

(56) References Cited

U.S. PATENT DOCUMENTS

| | | | | |
|---|---|---|---|---|
| 2006/0032622 | A1 | 2/2006 | Yen et al. | |
| 2007/0114011 | A1 | 5/2007 | Mamber | |
| 2007/0295496 | A1 | 12/2007 | Hall et al. | |
| 2010/0189901 | A1* | 7/2010 | Chung et al. | 427/256 |
| 2010/0190023 | A1* | 7/2010 | Gross | H01L 23/373 428/545 |
| 2010/0301260 | A1 | 12/2010 | Dai et al. | |
| 2013/0128461 | A1* | 5/2013 | Nagasawa | 361/704 |

* cited by examiner

HEAT EXCHANGER CONSTRUCTION USING LOW TEMPERATURE SINTER TECHNIQUES

BACKGROUND

1. Technical Field

The techniques described herein relate to a process for constructing heat exchangers using low temperature sinter techniques and the heat exchangers that result from the process.

2. Discussion of Related Art

Heat exchangers are used in a variety of applications, for example, cooling engines and cooling electronics. Techniques for constructing heat exchangers include brazing and organic bonding.

Brazing may be performed, for example, in a molten salt bath or in a vacuum furnace and requires very high temperatures (from 300° C. to 1100° C.). These high temperatures melt a brazing material, such as metals or compatible alloys (e.g. aluminum alloys), that is in contact with two or more other pieces of metal that are part of the heat exchanger. Upon cooling, the brazing material solidifies, forming a bond that thermally, and physically, couples the metal pieces together. The high temperature needed for brazing places limits on the heat exchangers being constructed. For example, the material used to make the heat exchanger must have a melting point higher than the brazing temperature. Moreover, the large temperature variation, from room temperature to the brazing temperature and back, require the materials that are chosen to have similar coefficients of thermal expansion (CTE). If the heat exchanger was constructed from metal with a large difference in CTE, the heat exchanger could break, warp or have unwanted residual stress upon cooling to room temperature. Limitations are also put on the choice of material based on the need to reduce galvanic corrosion.

Another restriction of brazing is that it typically requires special equipment, such as a molten salt bath or a vacuum furnace. Therefore, the brazing process requires purchasing expensive, specialized equipment or contracting an off-site brazing specialist, which can be both unaffordable and time-consuming, with lead times of greater than 16 weeks.

One alternative to brazing is organic bonding using a polymer bond solution. While this technique is much cheaper than brazing, the materials used to form the bond have a much higher thermal resistance than the brazing materials. For example, typical polymer bond solutions have a conductivity that is about 100 times lower than copper or silver. This reduction in conductivity reduces the ability to dissipate heat and results in reduced performance of the underlying device.

SUMMARY

Some embodiments relate to constructing a heat exchanger using nanoink as a thermal bond interface between portions of the heat exchanger. The heat exchanger may comprise fins and at least one base. A nanoink may be applied to at least a portion of the fins. Upon sintering the pieces, the nanoink melts and forms a bond between the pieces of the heat exchanger. Some embodiments include a second base.

In some embodiments, the fins and the base may be different materials. The base may, for example, by ceramic, metallic, or be a processor or printed wiring board. In some embodiments the nanoink may be comprised of metallic or thermally conductive nanoparticles.

Some embodiments relate to applying the nanoink to the base of the heat exchanger. The nanoink may be applied using an ink roller. In other embodiments, the nanoink may be applied using an inkjet technique.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Some embodiments are directed to the process of constructing a heat exchanger. The inventors have recognized and appreciated that by using nanoinks, the cost and time of constructing a heat exchanger may be significantly reduced while increasing the performance of the heat exchanger itself.

Heat exchangers may be used in military applications, such as in electronic actuators and/or other electronics used on aircraft or other vehicles. These components may be exposed to harsh environments such as salt-water, a wide range of water entrainment and a wide range of temperatures. Thus, heat exchangers should be constructed from materials that can withstand these demanding environments.

Using nanoink as an interface between components of a heat exchanger provides a wide range of construction options that are not available using brazing techniques while providing superior performance as compared to heat exchanger made using organic bonding. Nanoinks are a solution or paste of nanoparticles mixed with some "carrier solution" that controls the viscosity of the nanoink. The carrier solution is not limited in any way, but may be optimized based on the method used to apply the nanoink. For example, the carrier solution may be water, an alcohol, a hydrocarbon fluid or some other organic fluid. The nanoparticles in the nanoink may be, for example, metallic or thermally conductive nanoparticles. The prefix "nano" refers to the fact that the nanoparticles have a diameter that is best described in terms of nanometers (or $10^{-9}$ meters). The nanoparticles may have a diameter ranging from 1 nanometer to about 2500 nanometers.

The melting point of the metallic nanoparticles in nanoink is often much lower than the melting point of a bulk material made of the same metal. Therefore, a sintering technique may be used to melt the nanoparticles while in contact with other components of the heat exchanger, forming a bond between the components such that the components of the heat exchanger are thermally, and physically, coupled. Sintering occurs at a relatively low temperature compared to brazing, for example, in an oven set to the range of 100-300° C. Therefore, no special equipment is needed to sinter the heat exchanger because common ovens that are designed for other purposes may be used. This allows for a cheaper and shorter production schedule, because the construction does not need to be performed by a brazing specialist with access to specialized brazing equipment.

Furthermore, the nanoparticles in the nanoink may be made from a material that has a high thermal conductivity (i.e., a low thermal resistance). Thus, heat exchangers constructed using nanoinks may have thermal interface layers with conductivities that far exceed those possible using organic bonding techniques. For example, some interfaces formed from nanoinks may provide up to 80 times higher thermal conductivity than organic polymer bonds.

Figure 1:
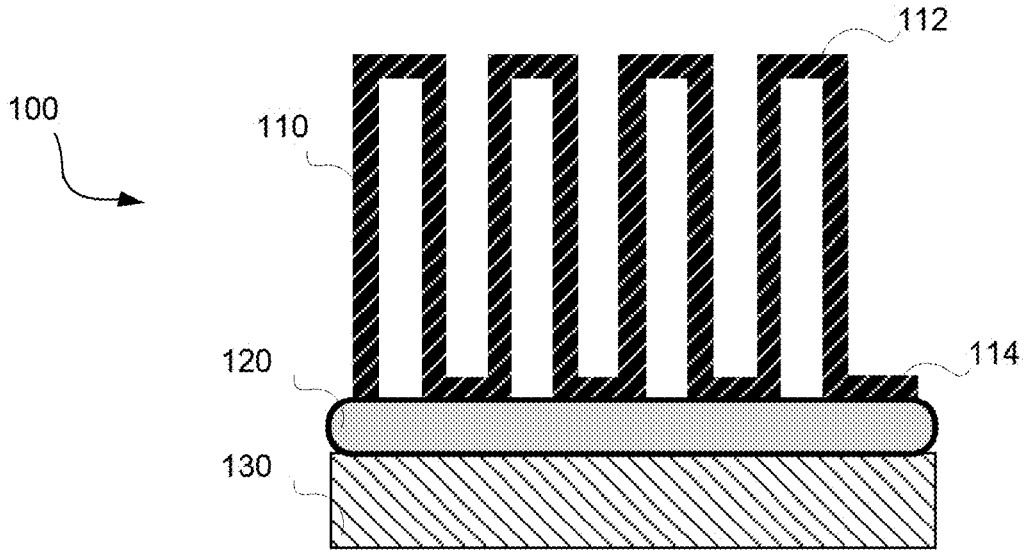
FIG. 1 is a simplified cross-section view of a heat exchanger, according to some embodiments.

FIG. 1 illustrates a simplified cross-section of a heat exchanger 100 formed using nanoinks and should not be interpreted as limiting the invention in any way. For example, heat exchangers constructed using the techniques of the present invention may have a variety of geometries or may be constructed from a variety of materials. FIG. 1 illustrates a base 130 comprised of a base material, fins 110 comprised of a fin material and a nanoink layer 120 comprised of sintered nanoparticles. The fins 110 are designed to increase the surface area and therefore increase the amount of heat that can be dissipated. The geometry and shape of the fins 110 are not limited in any way. For example, the fins 110 may be a rectangular corrugated material as illustrated in FIG. 1. In other embodiments, the fins 110 may be circular or rounded. Moreover, within one set of fins, the shape may differ from fin to fin. The fins 110 may be spaced in a regular or an irregular pattern. The fins 110 may be corrugated in one dimension, such that long ridges are formed, or the fins 110 may be corrugated in two dimensions, such that fins resemble a plurality of rectangular, tower-like protrusions. Many other variations of fin types, such as individual pins or lanced offset varieties, are envisioned and are easily incorporated into any embodiment herein.

The fins 110 may comprise at least one set of tips 112. The tips 112 generally define one side of the fins 110. There may be another set of tips 114 that oppose the first set of tips and define a second side of the fins 110, as shown in FIG. 1. However, in some embodiments, the fins 110 may only have a single set of tips 112 and may, instead of having tips 114, have a solid surface (not shown) on one side of the fins 110. FIG. 1 shows a plurality of tips 112 defining a first level and the tips 114 defining a second level. However, the tips are not limited to be at the same height. Some embodiments may have tips 112 at different levels or fins 110 with different shapes.

The base material and fin material are not limited in any way. The fins and the base may be made from the same material or different materials. A material with high thermal conductivity and low thermal resistance may be used. In some embodiments, the fins or the base may be made from a metal or metallic alloy, for example, aluminum, copper, silver, gold, or any other metal. In other embodiments, an inorganic or ceramic material may be used. For example, the base or fins may be constructed from a ceramic composite. In some embodiments, the fins and/or base may be made from thermal pyrolytic graphite or annealed pyrolytic graphite. Further embodiments may use diamond or silicon as a material for the base or the fins.

The nanoink layer 120 is formed from sintered nanoink. The nanoink may be formulated in any suitable way and is not limited to any particular type. In some embodiments, the nanoink comprises nanoparticles and a carrier solution. The nanoparticles are on the scale of nanometers (nm), for example, approximately 1 nm to about 2500 nm. The nanoparticles within a nanoink may be a consistent size with a well-defined range of diameters, or they may range in size. In some embodiments the nanoparticles are metallic. For example, the nanoparticles may be silver, gold, copper, platinum, aluminum, tungsten, nickel or any other metal. A nanoink is not limited to be comprised of a single metal and may contain several different metals in a single nanoink. In other embodiments, the nanoparticles may be carbon-based. For example, the nanoparticles may be carbon nanotubes or buckminsterfullerene. The nanoink may comprise a carrier solution that may comprise a solvent. Any suitable solvent may be used; the invention is not limited in this respect. For example, the solvent may be water, an alcohol, a hydrocarbon fluid or some other organic fluid. The carrier solution may also comprise a dispersant to keep the nanoparticles in suspension in the solvent.

The sintering process that forms the nanoink layer 120 results in the evaporation of most, or all, of the carrier solution, leaving the material from which the nanoparticles were formed. If, for example, the nanoparticles are silver, then the sintering process melts the silver nanoparticles such that the nanoparticles amalgamate to form bulk silver. There will be little to no trace of the carrier solution, which evaporates during sintering. The sintering process will be described below in more detail in conjunction with FIGS. 4-5.

Figure 2:
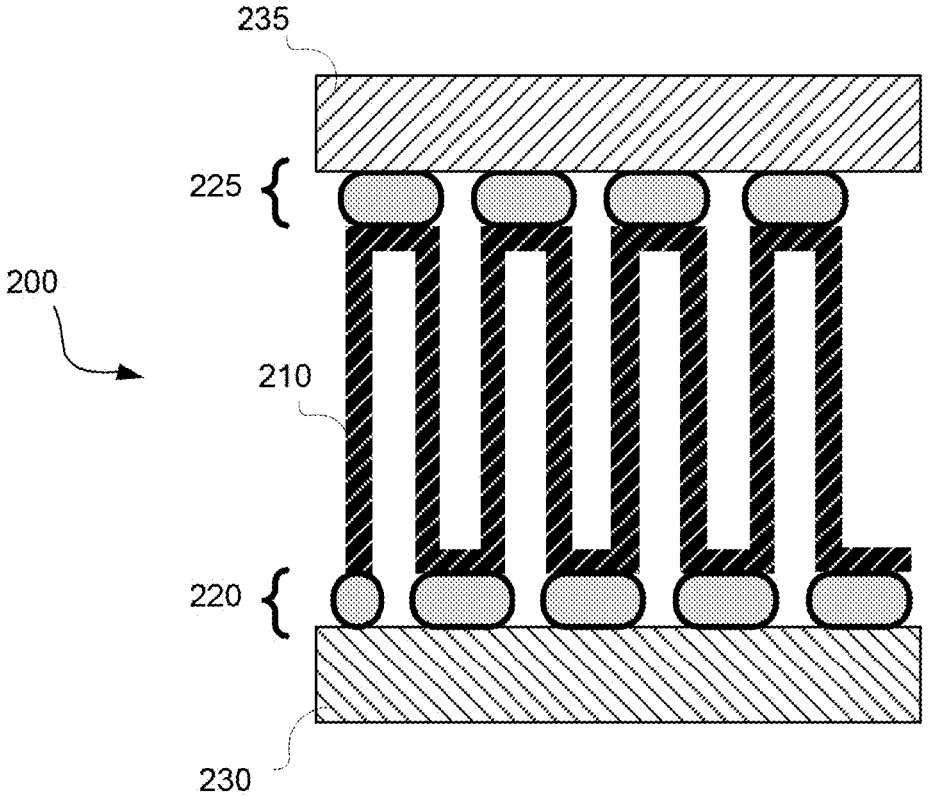
FIG. 2 is a simplified cross-section view of a heat exchanger, according to some embodiments.

FIG. 2 illustrates a simplified cross-section of another embodiment of a heat exchanger 200. Heat exchanger 200 comprises a base 230 and fins 210 similar to the heat exchanger 100 in FIG. 1. However, in this embodiment, there is a second base 235. This base 235 may be made of the same material or a different material than base 230. Just as discussed above, each of the bases 230 and 235 and/or the fins 210 may be configured in any suitable shape and comprised of any suitable material. The invention is not limited in this respect.

Heat exchanger 200 also comprises a second nanoink layer 225 in addition to the first nanoink layer 220. Nanoink layer 225 acts as an interface between the fins 210 and base 235 just as nanoink layer 220 acts an interface between the fins 210 and based 230. The particular design of each of the nanoink layers in FIGS. 1 and 2 are illustrated in a specific configuration, but may be configured in any suitable arrangement. For example, FIG. 2 shows nanoink layers 220 and 225 as discontinuous, whereas FIG. 1 shows nanoink layer 120 as continuous. The difference is due to how the nanoink is applied to the components of the heat exchanger and are discussed in more detail below in conjunction with FIG. 3. However, embodiments with a single base 130 are not limited to have a continuous nanoink layer 120. The nanoink layer could be discontinuous, as nanoink layer 220 in FIG. 2 is shown. Similarly, one or both of nanoink layers 220 and 225 illustrated in FIG. 2, could be continuous, as nanoink layer 120 in FIG. 1 is shown.

Figure 3:
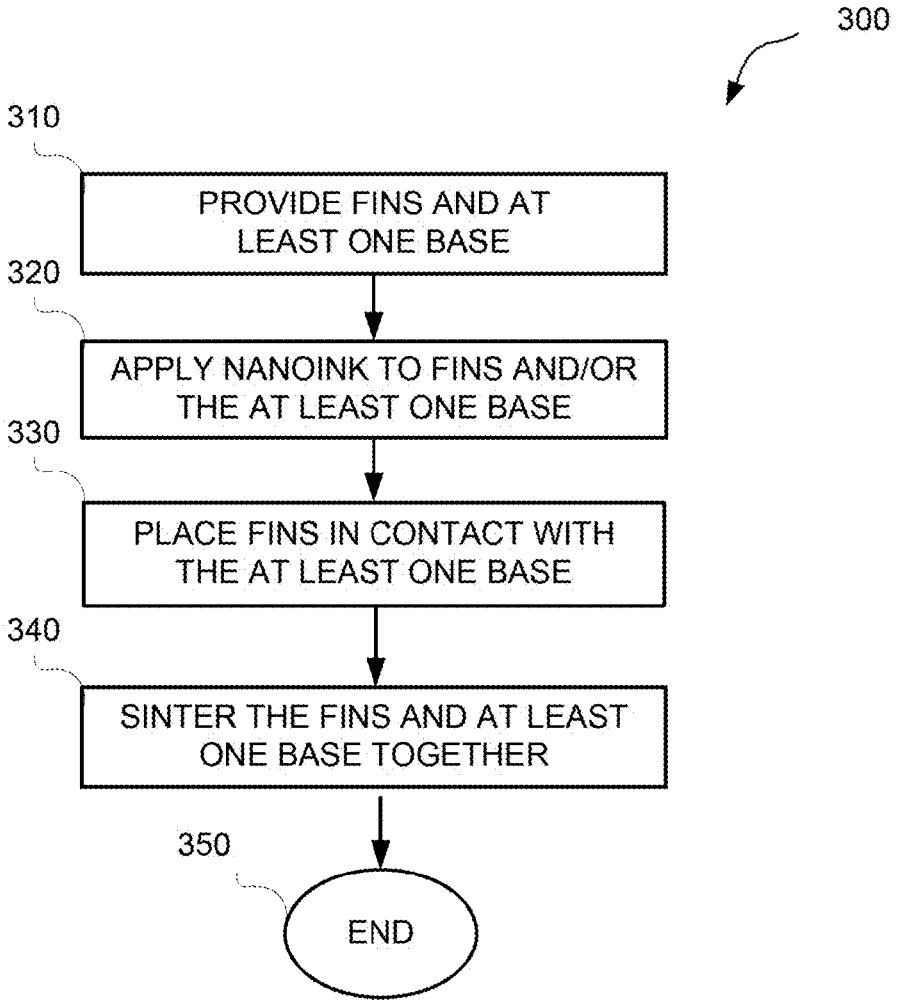
FIG. 3 is a flow chart of an exemplary process of constructing a heat exchanger.

FIG. 3 is a flow chart of an exemplary process 300 of constructing a heat exchanger. Fins and at least one base are provided at act 310. In some embodiments, a single base may be provided as illustrated in FIG. 1, or two bases may be provided as illustrated in FIG. 2. It is also possible that a plurality of bases are provided. For example, base 230 and or base 235 may each comprise multiple pieces. The invention is not limited in this respect.

At act 320, nanoink is applied to the fins and/or the at least one base. In some embodiments, nanoink may be applied to both the fins and the base. In some embodiments, the nanoink may be applied only to the tips of the fins. If the nanoink is only applied to the fins, the nanoink layer that is formed may be discontinuous as illustrated in FIG. 2. If, the nanoink is applied to only the base, or both the base and the fins, then the nanoink layer will be continuous, as illustrate in FIG. 1. By applying the nanoink to only the fins, the amount of nanoink used is reduced without significantly reducing the amount of heat that is conducted between the base and the fins. Due to the cost of commercial nanoinks, applying the nanoink to only the fins may reduce the total cost of producing the heat exchanger.

The nanoink may be applied in act 320 of FIG. 3 in any suitable way; the invention is not limited in this respect. For example, the nanoink may be applied to the base and/or the fins using an ink roller. This is may provide a low-cost, easy method of application. Using an ink roller ensures surface wetting and adhesion. Due to its simplicity, using ink rollers also reduces the capital investment in equipment needed to apply the nanoink. In other embodiments, the nanoink may be applied to the base and/or the fins using an inkjet nozzle. Whereas using an ink roller results in a relatively gross placement of the nanoink, using inkjet techniques allows the nanoink to be applied to the base and/or the fins in precise locations. For example, the nanoink may be applied to the base in a pattern determined by the designer of the heat exchanger.

Once the nanoink layer is applied to the at least one base and/or the fins, the fins and the base are placed such that at least a portion of the nanoink layer is in contact with both the base and the fins at act 330. Then, at act 340, the pieces are sintered together in an oven to bond the pieces together. The sintering may be achieved in any suitable way and the invention is not limited in this respect. For example, any type of furnace or oven may be used, any temperature may be used and the amount of time spent sintering may vary based on the determination of the heat exchanger designer. In some embodiments, the temperature of the oven is less than 300° C. It may be, for example, between 100-250° C. In further embodiments, the temperature of the oven may be less than 185° C., which is the approximate melting point of some common solder materials.

In some embodiments, the temperature of the oven may be determined based on the base material, the fin material and the nanoink. Using sintering at relatively low temperatures allows an entire new class of materials to be used as the base material and the fin material. For example, constructing heat exchangers using brazing required that the fins and base have approximately equal coefficients of thermal expansion (CTE). If the mismatch was too great, then the process of cooling from the brazing temperature of up to 1100° C. down to room temperature would result in breakage, warping or residual unwanted stress in the heat exchanger. The low oven temperature of sintering substantially reduces these same restrictions. Materials with vastly different CTEs may be used. For example, the base may be made from diamond (a low CTE material) and the fins may be made from aluminum (a relatively high CTE material).

In some embodiments, the low temperature of the sintering oven allows materials to be used that couldn't be used in brazing simply because the material itself would become damaged in the oven. For example, the base may itself be a circuit, microprocessor or a printed wiring board (PWB). By applying nanoink directly to a circuit, microprocessor or PWB, the number of layers needed to form the heat exchanger is decreased. If the base is a PWB with components already soldered thereon, the sintering must occur at a temperature lower than the melting point of solder, which is typically about 185° C. Applying the nanoink directly to a circuit, microprocessor or PWB, and not including an additional base, such as a metal or ceramic, increases performance because thermal resistance adds in series. Thus, each additional layer that is used in the construction of the heat exchanger reduces the thermal conductivity of thermal pathways within the device.

In some embodiments, the process of constructing the heat exchanger 300 ends at act 350 upon completion of the act of sintering 340. Constructing the complete heat exchanger may comprise additional acts that are not shown in FIG. 3. For example, because the sinter temperature is lower than the final bulk material melting point, the entire process may be sequentially repeated numerous times to fabricate multilayer structures, as shown in an exemplary heat exchanger 600 of FIG. 6, and will be discussed in more detail below. Unlike heat exchangers constructed using brazing, these multilayer structures could consist of different materials that would have been incompatible with a "one shot" brazing process. In some embodiments, for example, not every base is made of metal. For example, base 611 of heat exchanger 600 may be made from a material with a lower thermal conductivity than would normally be used. Any suitable material may be used. In some embodiments, the base may be made of ceramic. By selecting base materials with varying thermal conductivities, the flow of heat through the components of the heat exchanger may be controlled. This gives the designer of the heat exchanger much more flexibility in controlling heat flow than was previously possible.

Figure 4:
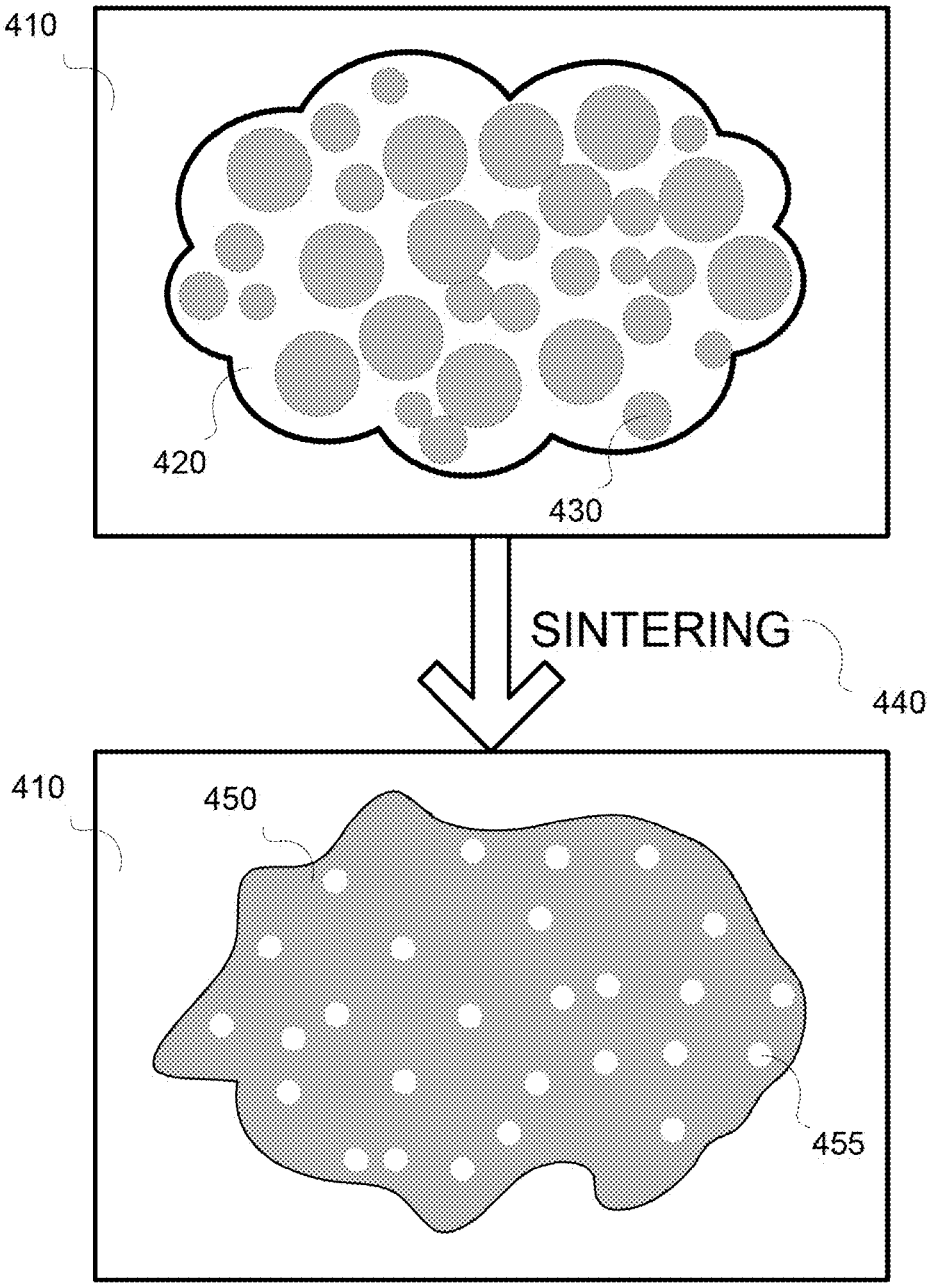
FIG. 4 is a simplified top-view illustration showing the effect of sintering on nanoink.

FIG. 4 is an illustration of the effect of sintering on the nanoink. The drawing is not drawn to scale and is for illustrative purposes only; the invention is not limited with respect to FIG. 4. FIG. 4 shows a top view of base 410. A nanoink comprising a carrier solution 420 and metallic nanoparticles 430 has been applied to a portion of the surface of the base 410. The nanoparticles 430, in this example, are not a uniform diameter. In some embodiments, the nanoink may be designed to have nanoparticles with diameters that fall within a specified range.

In the actual construction of a heat exchanger, fins would be placed in contact with at least a portion of the nanoink layer applied to the base. However, for purposes of illustration, the fins are not shown. The arrow 440 represents the sintering process, which may occur in any suitable manner, such as those described in various embodiments above in connection with FIG. 3. After the sintering is complete, the carrier solution 420 has evaporated and the metallic nanoparticles 420 have melted and amalgamated together to form a bulk metal 450 on the base 410. Incomplete evaporation of the carrier solution may result in porosity within the bulk metal 450. These pores 455 are shown for illustrative purposes and are not drawn to scale and do not represent the actual density of pores 455 that may result. The minimal porosity has negligible effects on thermal and structural performance of the bond. It is envisioned that the porosity may be intentionally adjusted to allow tuning the strength of the bond to enable reparability of the heat exchanger.

Figure 5:
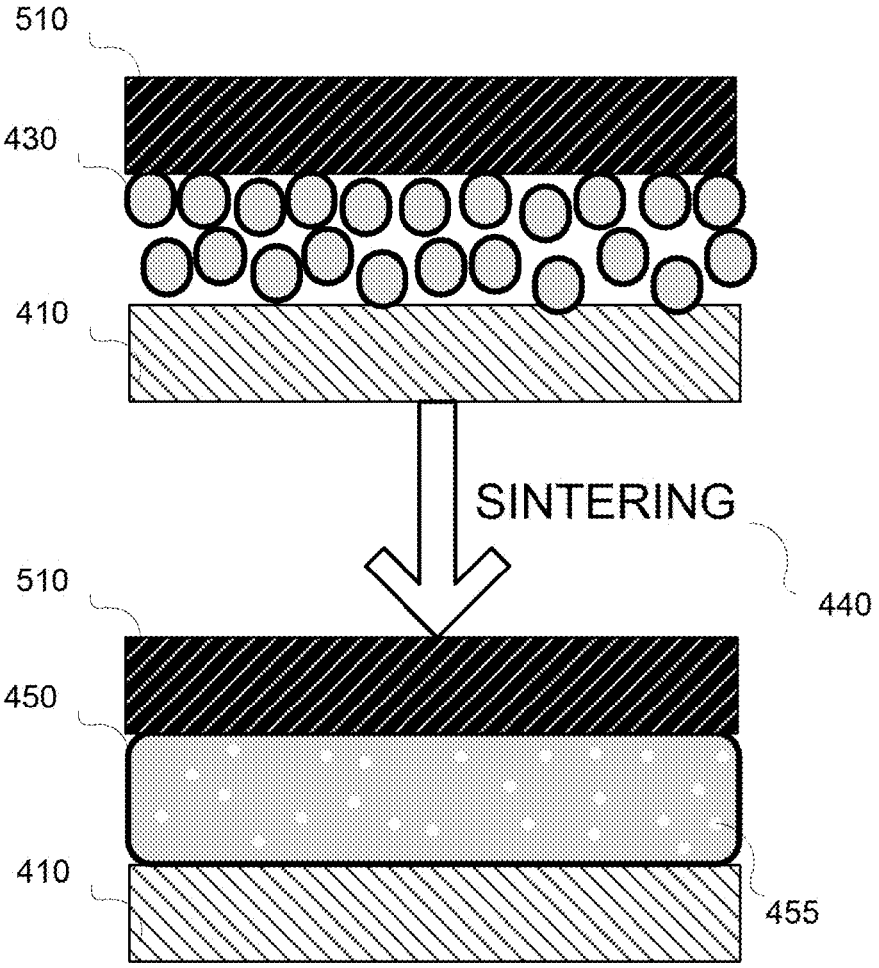
FIG. 5 is a simplified cross-section illustration showing the effect of sintering on nanoink.

FIG. 5 is a second illustration of the sintering process shown in cross-section. The drawing is not drawn to scale and is for illustrative purposes only; the invention is not limited with respect to FIG. 5. The same numbers are used as used in FIG. 4 to depict the same elements.

Fins 510 are shown in FIG. 5. A nanoink comprising nanoparticles 430 has been applied to the fins 510 and/or the base 410 and the pieces have been placed such that they are all in contact with at least a portion of one another as described in connection with FIG. 3. The carrier solution is not shown, for illustrative purposes, but it fills the gaps between nanoparticles 430. FIG. 5 only shows a couple diameters worth of nanoparticles in the nanoink layer between the base 410 and the fins 510. However, this is just for simplicity of the drawing. In reality, the nanoink layer is may be hundreds or thousands of diameters thick. The invention is not limited with respect to the thickness of the nanoink layer. Nor is it limited by the size of the base or the fins.

After sintering, the metallic nanoparticles 430 have amalgamated to form a bulk metal. Because the melting point of the nanoparticles is lower than the melting point of the bulk material, the sintering process may be considered a one way process. For example, though the heat exchanger may be formed by sintering at low temperatures, the device itself may operate at much hotter temperatures because the melting point of the nanoink layer after sintering may be much higher. In one embodiment, the fins, the base and the metallic nanoparticles may be comprised from the same metal. This was not possible using brazing because if the oven was hot enough to melt the brazing material melted, then the base and fins would also melt. However, because of the lower melting point of the nanoparticles, it is possible to construct a heat exchanger of a single type of metal.

Figure 6:
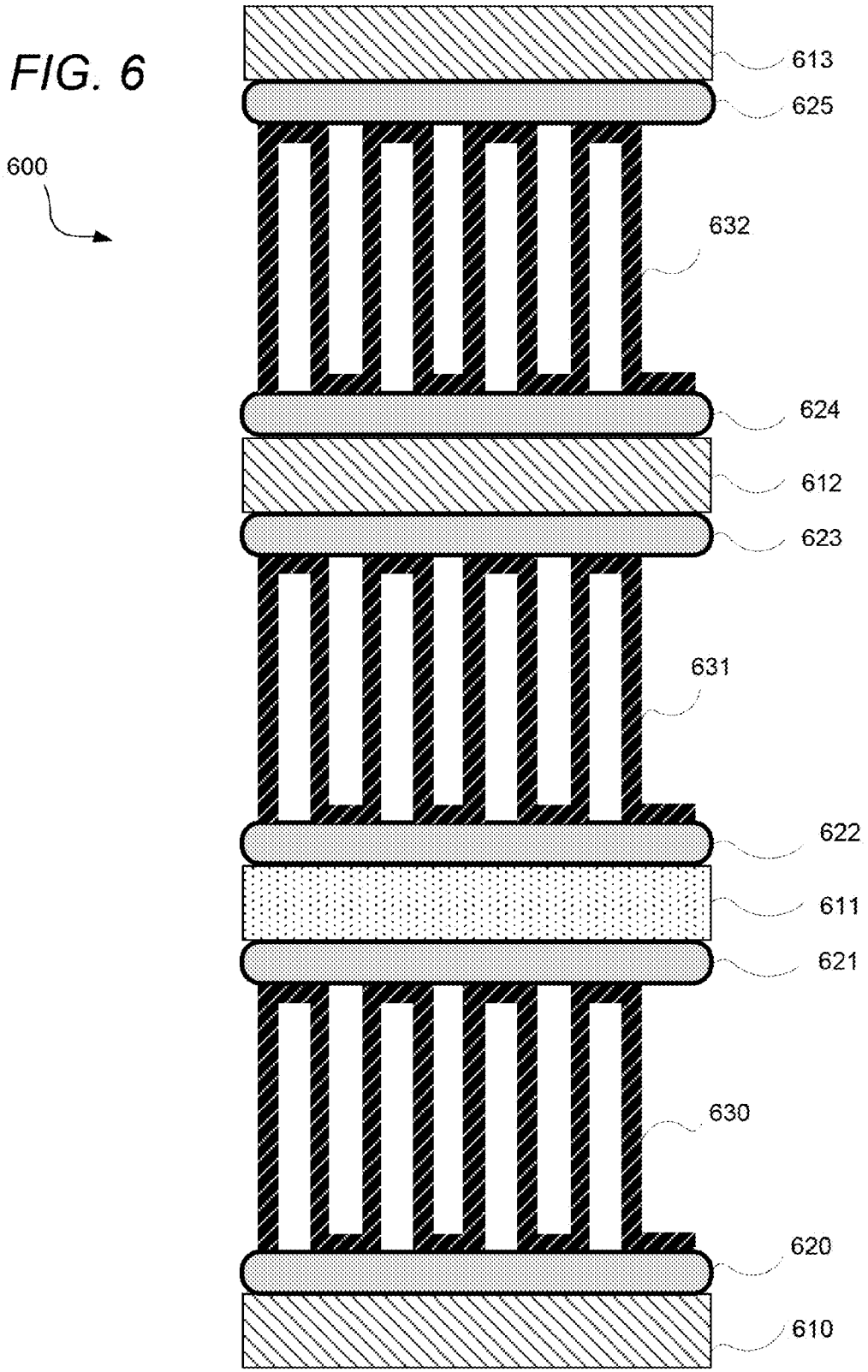
FIG. 6 is a simplified cross-section view of a multi-layer heat exchanger, according to some embodiments.

FIG. 6 illustrates a multilayer heat exchanger of some embodiments. If acts 310, 320 and 330 of method 300 shown in FIG. 3 are repeated, multilayer heat exchanger may result. For example, heat exchanger 600 may comprise a plurality of fins 630-632, a plurality of sintered nanoink layers 620-625, and a plurality of bases 610-613. In some embodiments, there may be inner bases 611-612 and outer bases 610 and 613. The bases 610-613 may be made from the same material or from different materials. If the base materials for each of the bases is a different material, then each base may have a different thermal conductivity. These varying thermal conductivities may be used to control the flow of heat through the layers of the heat exchanger. For example, if base 611 is made from a material with a low thermal conductivity, then the heat that flows through base 611 will be significantly less than the heat that flows through base 612, if base 612 is made from a highly thermally conductive material.

As described above, any suitable material may be used for each of the base layers. Embodiments are not limited to any particular type of material or thermal conductivity. For example, the base may be a thermal insulator.

This invention is not limited in its application to the details of construction and the arrangement of components set forth in the foregoing description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which at least one example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method for use in relation to a heat exchanger used in conducting heat from a heat source, the heat exchanger comprising a base comprised of a base material and fins comprised of a fin material, the method comprising acts of:

applying nanoink to at least a portion of one of the fins and the base to create a nanoink layer, wherein the nanoink comprises nanoparticles having at least one melting point;

arranging the fins and the base, after applying the nanoink to at least the portion of the one of the fins and the base, such that at least a portion of the nanoink layer resides between the one of the fins and the base and the other of the fins and the base;

after arranging the fins and the base, sintering the base, the fins and the nanoink layer at a sintering temperature which meets or exceeds at least one melting point of the nanoparticles, the sintering temperature being less than or equal to 300 degrees Celsius;

cooling the base, the fins and the nanoink layer to form a bond between the base and the fins; and after the cooling, subjecting the heat exchanger to heat from the heat source at a second temperature which meets or exceeds the sintering temperature, without compromising the bond formed between the base and the fins.

2. The method of claim 1, wherein the nanoparticles are comprised of a thermally conductive material.

3. The method of claim 1, wherein the act of subjecting the heat exchanger to a second temperature comprises repeating the acts of the method for a plurality of base and fin layers of same or different materials to create a multilayer heat exchanger.

4. The method of claim 1, wherein the base material and the fin material are different materials.

5. The method of claim 4, wherein the base material is an inorganic material.

6. The method of claim 1, wherein the base material is a metallic material.

7. The method of claim 1, where in the base is a processor or printed wiring board.

8. The method of claim 1, wherein the act of applying the nanoink to at least a portion of the one of the fins and the base uses an ink roller.

9. The method of claim 1, wherein the act of applying the nanoink to at least a portion of the fins uses an inkjet nozzle.

10. The method of claim 1, wherein the base is a first base comprised of a first base material, the nanoink layer is a first nanoink layer, and the portion of the fins is a first portion of the fins, and wherein the act of subjecting the heat exchanger to the second temperature comprises acts of:

providing a second base comprised of a second base material;

applying a second nanoink layer to at least a second portion of the fins;

placing the fins and the second base, after applying the nanoink to at least the second portion of the fins, such that at least a portion of the second nanoink layer is in contact with the second base;

sintering the second base, the fins, and the second nanoink layer at the second temperature; and cooling the second base, the fins, and the second nanoink layer to form a bond between the second base and the fins.

11. The method of claim 1, wherein the sintering temperature is below 250 degrees Celsius and above 100 degrees Celsius.

12. The method of claim 1, wherein the sintering temperature is below 185 degrees Celsius.

13. The method of claim 2, wherein the nanoparticles are comprised of a metallic material.

14. The method of claim 13, wherein the nanoparticles are comprised of a material selected from the group consisting of aluminum, copper, tungsten, platinum and gold.

15. The method of claim 2, wherein the nanoparticles comprise carbon.

16. The method of claim 15, wherein the nanoparticles comprise carbon nanotubes.

17. The method of claim 1, wherein the act of subjecting the heat exchanger to the second temperature comprises using the heat exchanger to cool a device operating at the second temperature.

* * * * *